US006502446B2

(12) United States Patent
Potthoff

(10) Patent No.: US 6,502,446 B2
(45) Date of Patent: Jan. 7, 2003

(54) ROLLING UNIT FOR A ROLLING MILL FOR ROLLING OR SIZING METAL PIPES, BARS OR WIRES

(75) Inventor: Heinrich Potthoff, Hilden (DE)

(73) Assignee: Kocks Technik GmbH & Co, Hilden (DE)

( * ) Notice: Subject to any disclaimer, the term of this patent is extended or adjusted under 35 U.S.C. 154(b) by 0 days.

(21) Appl. No.: 09/819,323

(22) Filed: Mar. 28, 2001

(65) Prior Publication Data

US 2001/0027674 A1 Oct. 11, 2001

(30) Foreign Application Priority Data

Mar. 28, 2000 (DE) ..... 100 15 339

(51) Int. Cl.[7] ..... B21B 13/10
(52) U.S. Cl. ..... 72/224; 72/235; 72/246
(58) Field of Search ..... 72/224, 235, 237, 72/246, 248, 249

(56) References Cited

U.S. PATENT DOCUMENTS 3,861,187 A * 1/1975 Leeuwestein ..... 72/248
4,569,217 A * 2/1986 Properzi ..... 72/224
5,144,827 A * 9/1992 Iio ..... 72/224
6,035,685 A * 3/2000 Takai et al. ..... 72/235

FOREIGN PATENT DOCUMENTS

WO 98/06515 2/1998

* cited by examiner

*Primary Examiner*—Ed Tolan
(74) *Attorney, Agent, or Firm*—Michael J. Striker

(57) ABSTRACT

A rolling unit for a rolling mill for rolling or sizing metal pipes, bars or wires has at least three rolls arranged in a star arrangement. Each roll has a separate drive mechanism and is rotatably mounted on bearings on both sides of it. The rolls are adjustable radially together with the bearings. The improved rolling unit has smaller outside dimensions but can take a higher load. The number of individual rolling unit parts is also reduced as well as manufacturing and assembly expenses. For this purpose the bearings of the roll shafts are mounted in respective eccentric sleeves, whose rotational position may be adjusted manually and in a stepwise manner between several rotational positions.

9 Claims, 4 Drawing Sheets

ROLLING UNIT FOR A ROLLING MILL FOR ROLLING OR SIZING METAL PIPES, BARS OR WIRES

BACKGROUND OF THE INVENTION

1. Field of the Invention

The present invention relates to a rolling unit for a rolling mill for rolling or sizing metal pipes, bars or wires having at least three rolls arranged in a star-shaped arrangement around a rolling mill axis, each of which has a separate drive means and is rotatably mounted by means of a roll shaft and bearings arranged on both sides of each roll. Each roll is mounted in a rolling unit housing so that it is radially adjustable in the rolling unit housing.

2. Prior Art

A rolling unit of this type has already been disclosed in WO 98/06515. The rolls there are mounted in built-in components, with which they can be shifted in a radial direction relative to the rolling mill axis within the rolling unit housing. Devices for shifting and holding the built-in components and thus the rolls in a radial direction are arranged in a rolling unit frame, which surrounds the rolling unit housing. The drive units provided for driving the rolls are located outside of the rolling unit frame.

This sort of rolling unit has the disadvantage that its outer dimensions are comparatively large and a considerable amount of space is required for the entire rolling mill. This results, above all, from the arrangement and structure of the adjusting devices for radially adjusting and holding the built-in components. These adjusting device require much space in a radial direction. Space is required for pre-tensioning means for producing tension arranged between the built-in components and devices for radial adjustment. Thus when no rolled goods are being rolled, there is no play between these parts. Consequently particularly large outer dimensions are required for the rolling unit frame supporting these devices and the rolling unit housing. The rolling unit frame and the rolling unit housing of course are separate parts in the known structure, but only together do they form a functional unit, i.e. an especially large complete rolling apparatus with radially adjustable rolls. Since the drive units for the rolls are arranged outside of the rolling unit frame, considerable spacing of the drive units from the rolling mill axis and thus the rolling mill has considerable dimensions in a radial direction. However the known rolling unit also has a large axial width, i.e. in the direction of the rolling mill axis, because the built-in components are held in place by swivel pins, which are arranged laterally next to the rolling unit housings. Because of that large spacing of the rolling units and thus also of the calibrated openings formed by the rolls from each other results, which has the consequence that the length of the unusable thicker end section of the rolled goods is considerably large. Also the waste during production is large.

Furthermore manufacturing expenses are especially high for the known rolling unit, because of the use of built-in components and devices for holding, guiding and radially adjusting the built-in components, which must be made with numerous individual parts and assembled.

Furthermore the known rolling unit has a weak structure because of the numerous individual parts, which give way too much to the forces occurring during rolling. The known rolling unit thus does not maintain the rolls in their provided positions with sufficient accuracy and reliability continuously in the required manner under the currently common high loads produced by the forces on the rolls. Because of that the required narrow tolerances for the rolled goods are not maintained. The flexibility of the known structure toward the forces acting on the rolls is based, above all, on the fact that the built-in components are only held in the structure by swivel pins. Furthermore the forces are conducted through several individual parts and thus over a comparatively long distance, which leads to a comparatively large elastic deformation. Furthermore exact adjustment of the rolls is impaired by wear, which is to be expected in the region of the operating surfaces between the linearly moving devices for radial adjustment of the built-in components and the built-in components that are pivotable on a circular path. Primarily there is a danger that these operating surfaces are temporarily exposed to dirt or dust when the rolling unit housing is removed.

An additional disadvantage of the known rolling unit is that the diameter of the opening formed by the rolls cannot be adjusted and measured when the rolling unit housing is in the workshop. This is because in the workshop the built-in components take arbitrary positions in the rolling unit housing and these can always be changed. In the workshop the built-in components and the rolls are guided of course in a radial direction in the rolling unit housing, however are not fixed in position. The devices for radially adjusting and holding the built-in components and rolls are missing. As already mentioned, these devices are arranged in the rolling unit frame, which is fast attached in the rolling mill, thus they cannot be transported together with the rolling unit housing in the workshop. However when the rolling unit housing is again inserted in the rolling unit frame and thus in the rolling mill, the devices for radial adjustment and holding can cooperate again. Then the built-in components and the rolls take certain adjustable positions relative to the rolling mill axis. However the position of the rolls and thus the diameter of the opening between them is then not measured in most rolling units because its rolling unit housing is inside the rolling unit frame. Then the rolls are arranged close to each other in the rolling mill so that only the opening between them in the first and last rolling unit can be reached and measured. Even if the opening between the rolls could be adjusted to the same diameter with special devices in the workshop as it is when adjusted by the devices for radial adjustment and holding of the built-in components and rolls in the rolling mill, this would still not be sufficient if the average position of the rolling unit housing relative to these special devices in the workshop and to the devices for radial adjustment and retention of the built-in components in the rolling mill is not maintained equal or the same with extreme accuracy. Each deviation even with constant diameter of the roll openings leads to an axially incorrect position of the rolls and thus necessarily to sizing errors.

SUMMARY OF THE INVENTION

It is an object of the present invention to provide a rolling unit for a rolling mill for rolling or sizing metal pipes, bars and wires, which does not have the above-described disadvantages, but which allows a stable, but radially adjustable, positioning of the rolls with as small as possible dimensions and comparatively small manufacturing expense.

These objects, and others that will be made more apparent hereinafter, are attained in a rolling unit having at least three rolls arranged in a star configuration or arrangement around the rolling mill axis, each of which has a separate drive means and is rotatably mounted by means of a roll shaft and bearings arranged on both sides of each roll. Each roll is mounted in a rolling unit housing so that it is radially adjustable in the rolling unit housing.

According to the invention this object is attained by a rolling unit of this type in which the bearings for the roll shafts are roller bearings and they are located within eccentric sleeves which are arranged rotatably in bearing passages provided in the rolling unit housing. The rotational positions of the eccentric sleeves may be changed by hand or manually in a stepwise manner without an adjusting device and secured in any of these rotational positions.

The rolling unit according to the invention has a very compact structure with only very small outer dimensions. That is due to the fact that the devices for adjusting and maintaining the rolls comprise eccentric sleeves. The eccentric sleeves, in contrast to the known built-in components, and the devices required for them to adjust and maintain their position, require comparatively little space, so that they can be accommodated entirely within the rolling unit housing. Also the rolling unit housing can be kept comparatively small despite the fact that these devices are housed in it. Furthermore a rolling unit frame is no longer required. Swivel pins for holding the built-in components are also not required. Consequently the rolling unit according to the invention has considerably smaller dimensions both in the radial and axial direction than the prior art rolling unit. Also the drive units can be arranged at comparatively shorter distances from the rolling mill axis. A rolling mill, which has considerably smaller dimensions in all directions and which takes up considerably smaller space than the rolling mill with the prior art rolling unit, results. With the rolling unit according to the invention it is possible to keep the spacing of the rolling units from each other small. Thus the unavoidably thicker end section of the rolled goods is shorter and the production waste is kept smaller than with the prior art rolling unit.

Furthermore the number of individual parts in the rolling unit according to the invention is considerably less than in the prior art rolling unit. This reduces both the amount of work and the costs for manufacture and assembly. With this economical rolling unit with nevertheless adjustable rolls according to the invention it is no longer necessary to avoid using rolling units with adjustable rolls in most stand positions of the rolling mills. Each stand position of the rolling mills can have a rolling unit with adjustable rolls. This better utilizes the rolls.

In addition greater stability results because of the compact structure for the new rolling unit according to the invention. The rolling mill according to the invention can take higher rolling forces. The occurring forces are conducted to the rolling unit housing over the shortest distances so that they are borne directly by it and thus no noteworthy elastic deformations occur. All parts, which are required for adjustment and holding the rolls, are arranged within the rolling unit housing and are thus protected from dirt or dust. The wear of these parts is thereby reduced, which guarantees exact positioning of the rolls over the operating life of the rolling unit.

Since the adjustment of the rolls occurs by rotation of the eccentric sleeves and this occurs by hand, the expense for the adjusting device is eliminated. The desired and required spacing of the rotation axes of the rolls from the rolling mill axis within their adjustment range is guaranteed by the stepwise adjustment even though it is performed by hand and without a synchronizing adjusting device. This spacing is basically established during machining of the working surfaces of the rolls. When the eccentric sleeves belonging to these rolls are then brought into their correct positions, the diameter of the roll unit opening no longer needs to be measured and individually calibrated. This is simultaneously and above all possible in the workshop, because the rolls take and maintain a predetermined position there after construction. Rolls with different ideal roll diameters, which means with different spacing of the rotation axes from the rolling mill axis, can be used because of the separate drive mechanisms for each roll. This allows an especially wide application of the rolls and reduces operating costs.

In a preferred embodiment of the invention the rolling unit housing is undivided or in one-piece. The one-piece structure for the rolling unit housing is facilitated by the individual drive devices for the rolls and the absence of drive gears required for the drive devices in the rolling unit housing. The rolling unit housing may be made with considerably reduced expense, because the painstakingly machined separate parts of the housing made and sealed together in several steps, as well as the numerous holes for adjusting pins and connecting screws, which are necessary to hold the parts together, are eliminated.

In a preferred embodiment of the invention each of the roll shafts is divided into two shaft portions. Each roll is clamped between the opposing surfaces of two shaft portions on which it is mounted, but so that it is releasable. The multi-part structure of the roll shafts allows axial clamping of the rolls between the facing surfaces of the two shaft portions. Because of this structure weakened connections between the rolls and roll shafts with radially projecting adjusting springs and similar elements on the roll shafts and in the passages of the rolls are avoided. Above all the multi-part structure of the roll shafts permits a rapid exchange of the rolls. Also when the axial clamping force between the shaft portions is relieved, they are only moved slightly apart so that the roll can be taken out in a radial direction from the rolling unit. After that another roll is placed between both shaft portions and clamped there in a radial direction in the rolling unit. Laborious disassembly of the rolling unit housing and/or the bearings of the rolls thus is not necessary. A more rapid exchange of the rolls is possible so that fewer rolling units are out of service, because the preparation time for a new use with the rolling units not in the mill train or rolling mill is short so that they are already available again when the rolling units currently in use must be exchanged. Scarcely more than two sets of the new rolling units are thus required for the rolling mill. Furthermore the rapid and simple roll exchanges make a reworking or re-machining of the rolls in the built-in state and the required special machine for that purpose superfluous, because the rolls can be rapidly taken out of the rolling unit for re-machining in a standard machine. They can also be rapidly put back into the rolling unit.

With the two-part structure for the roll shafts it is advisable that the opposing surfaces of the shaft portions and the rolls have respective projections and corresponding depressions that engage with each other in a form-locking manner. These projections and depressions are not to be confused with the above-mentioned radially projecting adjusting springs and similar elements, because the common projections and depressions extend in the axial direction and thus do not have the above-described weakening effect. They permit a high torque transfer without relative motion between the rolls and roll shafts.

Usually the opposing surfaces of the shaft portions have smaller diameters than the bearing passages between the drive devices and the rolls provided in the rolling unit housing. Furthermore in another preferred embodiment each bearing passage for each roll shaft is less than or equal in size to another bearing passage for that same roll shaft, which is located before or in front of the one bearing passage in a direction from the drive mechanism associated therewith to an interior of the rolling unit housing. Because of this size relationship it is possible to construct the shaft portions of the roll shafts, the bearings and eccentric sleeves outside of the rolling unit housing and then to insert them into the rolling unit housing from the drive side. These dimensions decrease or reduce the parts arranged in the one-piece rolling unit housing and simplify their assembly.

In a preferred embodiment of the invention the eccentric sleeve on a drive-mechanism-side of the roll on each roll shaft has a flange facing the drive mechanism or device and a retaining ring is screwed onto the rolling unit housing so that the eccentric sleeves can rotate, but are axially fixed. This permits rotation of the eccentric sleeve and thus radial adjustment of the rolls, but prevents undesirable axial shifts of the rolls and their bearings.

In various preferred embodiments the eccentric sleeve on a drive-mechanism-side of the roll on each roll shaft has a flange facing the drive mechanism or unit, a plurality of securing passages are distributed circumferentially in respective opposing surfaces of the flange and of a part of the rolling unit housing covered by the flange and a plurality of pins or screws are provided for insertion in the securing passages for aligning and holding the eccentric sleeve in one of the rotational positions. This sort of structure permits adjustment of the eccentric sleeves. by simple means and thus the rolls by hand; it also allows them to be fixed reliably in the adjusted rotation position. In additional possible embodiments at least one eccentric sleeve for each roll shaft is provided with radial passages circumferentially distributed in outer peripheral surfaces of the at least one eccentric sleeve and at least one retaining screw is screwed into at least one of the radial passages from outside through a wall of the rolling unit housing in order to secure the at least one eccentric sleeve in one of the rotational positions in the rolling unit housing. Different embodiments for securing the eccentric sleeve or sleeves in one rotational position can be employed in the same rolling unit or even the same roll shaft.

In many cases it is important to secure the eccentric sleeves for each roll shaft arranged on both sides of the roll on it so that they are nonrotatable, but releasable, and spaced from each other. A connecting strap embracing the roll can be used for this purpose. It is sufficient when only one of both eccentric sleeves on the roll shaft, which are located on both sides of the roll on it, is directly axially fixed and fixed in one rotational position, because the other eccentric sleeve then is also held in one rotational position and axially fixed by means of the connecting strap. Then only one of the eccentric sleeves is adjusted during the adjustment of the rotational position of the rolls, because the second eccentric sleeve rotates with it by means of the connecting strap.

BRIEF DESCRIPTION OF THE DRAWINGS

The objects, features and advantages of the invention will now be illustrated in more detail with the aid of the following description of the preferred embodiments, with reference to the accompanying figures in which.

DESCRIPTION OF THE PREFERRED EMBODIMENTS

Figure 1:
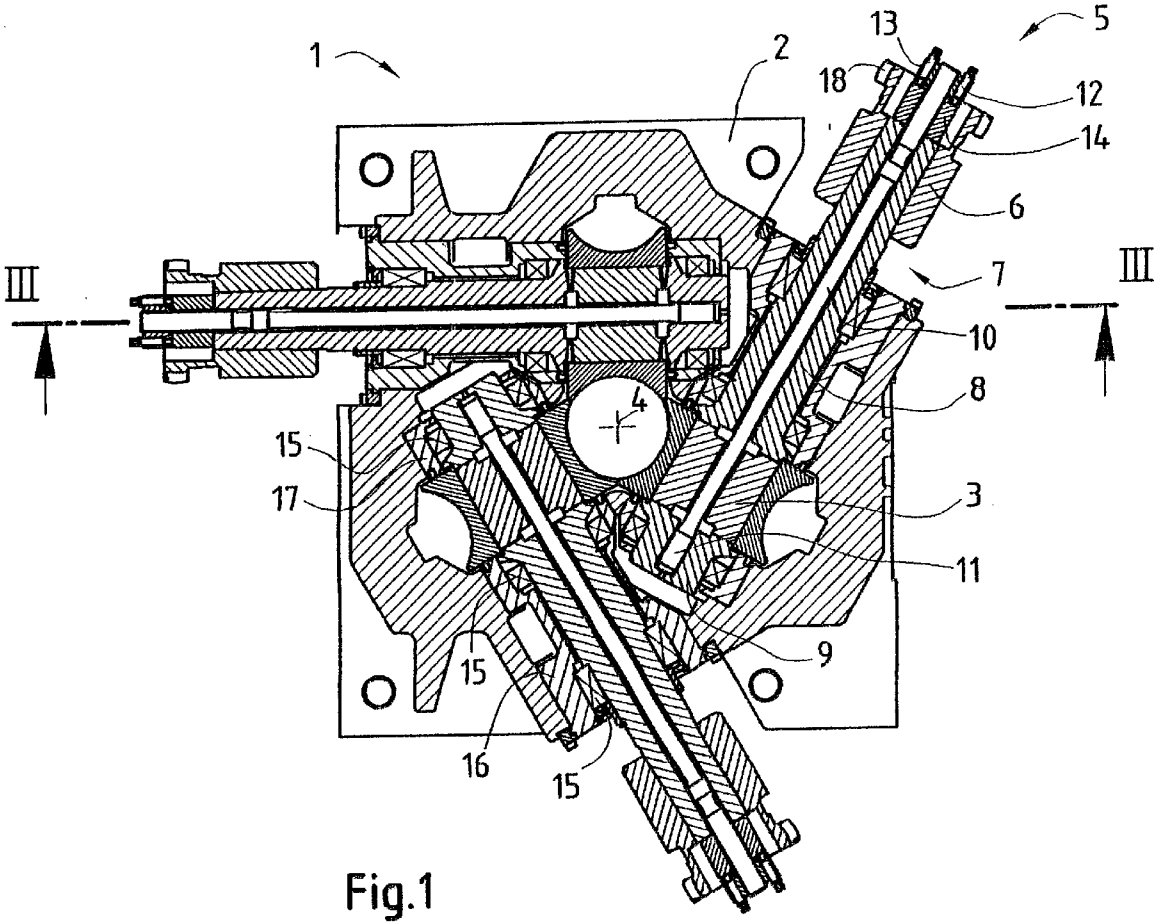
FIG. 1 is a cross-sectional view through a rolling unit according to the invention.

The rolling unit 1 shown in FIG. 1 has a rolling unit housing 2, in which three rolls 3 are arranged in a star arrangement or configuration. The three rolls 3 surround a rolling mill axis 4 in this arrangement. Each roll 3 has a separate drive mechanism 5. Each separate drive mechanism 5 exerts a drive torque produced by a respective unshown drive unit on the driven roll 3. Torque is transmitted to the driven roll 3 by means of a coupling half 6, which is nonrotatably connected to a roll shaft 7.

The roll shafts 7 each comprise two shaft portions 8 and 9. The rolls 3 are clamped between these shaft portions 8 and 9. The required axial force is exerted by a tie rod or tension rod 10, which is screwed into the shaft portion 9 with an end section 11 and which carries a tensioning nut 12 on its other end section. The tie rod or tension rod 10 is put under tension by means of several tensioning screws 13 in the tensioning nut 12. The tensioning screws 13 are braced on a spacer 14 and the spacer rests on shaft portion 8 for this purpose. Also a hydraulic or pneumatic tightening device can be used instead of the above-described part 12 to 14.

To change the rolls 3 the tensioning nut 12 is loosened and the tie rod 10 is relieved of tension. The end section 11 is then screwed out from the shaft portion 9 and the tie rod 10 can be drawn out from the roll 3, so that it can be replaced or exchanged, since both shaft portions 8,9 have been drawn apart from each other. If another roll 3 is placed between opposing surfaces of the shaft portions 8,9, the tie rod is screwed in with its end portion 11 again and after that put under tension again with the help of the nut 12.

Each roll 3 is mounted so that it is rotatable by means of the roll shaft 7 on roller bearings 15 on both sides of the roll. The roller bearings 15 are arranged within eccentric sleeves 16,17 that are provided in respective bearing passages 16',17' in the housing. The eccentric sleeve 16 is arranged on the driven side of the roll 3 and two roller bearings 15 are arranged in it. Only one roller bearing 15 is arranged in another eccentric sleeve 17 on the other side of the roll 3. The shorter shaft portion 9 is arranged in this other eccentric sleeve 17.

Figure 2:
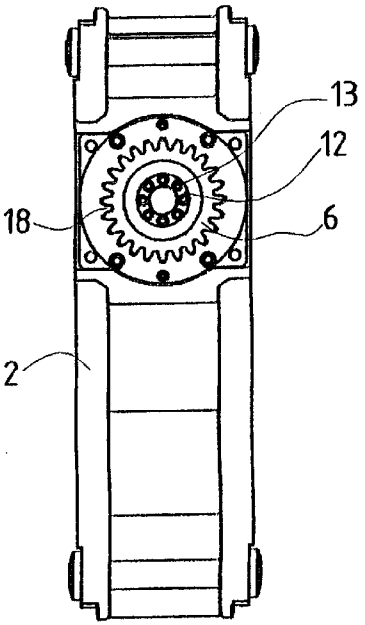
FIG. 2 is a side view of the rolling unit shown in FIG. 1.

FIG. 2 shows a coupling half 6 With gear teeth 18 in which an unshown second coupling half engaged.

Figure 3:
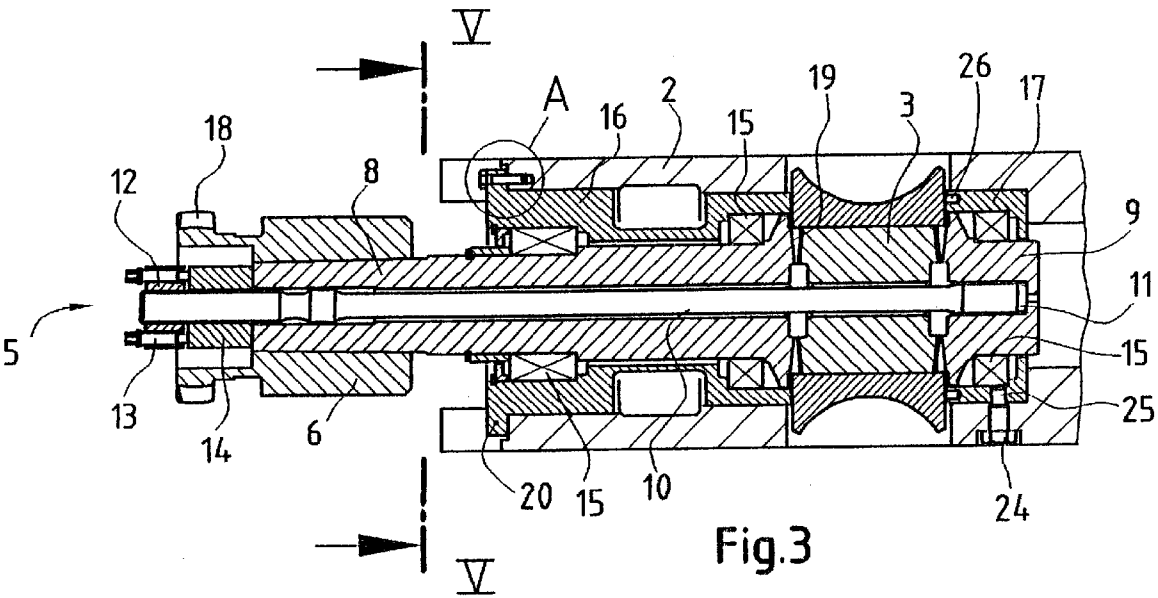
FIG. 3 is a cross-sectional view through the rolling unit shown in FIG. 1 taken along the section line III—III in FIG. 1.

FIG. 3 shows, more clearly than FIG. 1, that the opposing surfaces of the shaft portions 8 and 9 facing each other can have respective projections and depressions 19 which engage in corresponding projections and depressions 19 of the opposing surfaces of the roll 3. Since a comparatively small torque can be expected, the projections and depressions 19 can be eliminated, as shown for both lower rolls 3 in FIG. 1.

Figure 4:
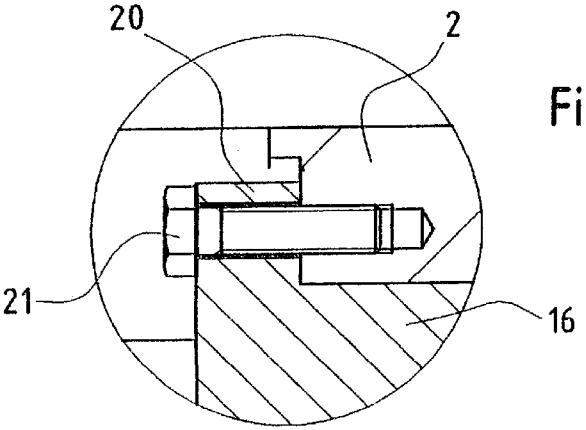
FIG. 4 is a detailed cutaway cross-sectional view through a portion A of the rolling unit show in FIG. 3.
Figure 5:
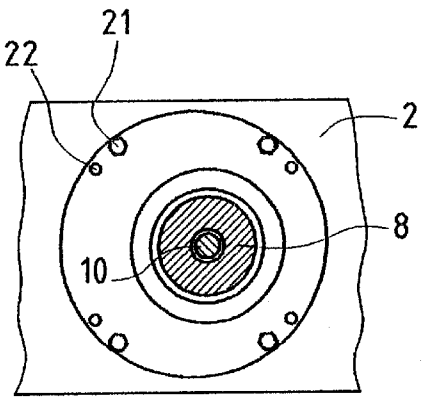
FIG. 5 is a cross-sectional view through the rolling unit shown in FIG. 3 taken along the section line V—V in FIG. 3.

In FIGS. 3 and 4 the driven-side eccentric sleeve 16 has a flange 20 facing the drive mechanism 5. The flange 20 and with it the eccentric sleeve 16 is rigidly attached with screws 21 in an axially unmovable manner in a predetermined rotational position. Several additional screw holes as shown in FIG. 5 permit the eccentric sleeve 16 to be secured in other rotational positions. Of course a still greater number of screw holes than are shown in FIG. 5 are possible in unshown embodiments. The rotational positions of the eccentric sleeve 16 allow roll position changes by manual rotation, when the screws 21 are removed. The eccentric sleeve 16 can be secured in a new rotational position by introducing the screws 21 in other screw holes 22. The eccentricity visible in FIG. 5 shifts the rotation axis of the roll 3 in a radial direction by the change in rotational position of the eccentric sleeve 16.

Figure 7:
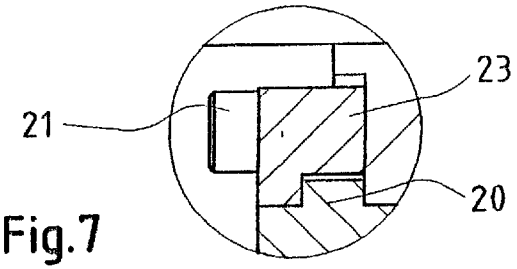
FIG. 7 is a detailed cutaway cross-sectional view through a portion B of the rolling unit shown FIG. 6.
Figure 6:
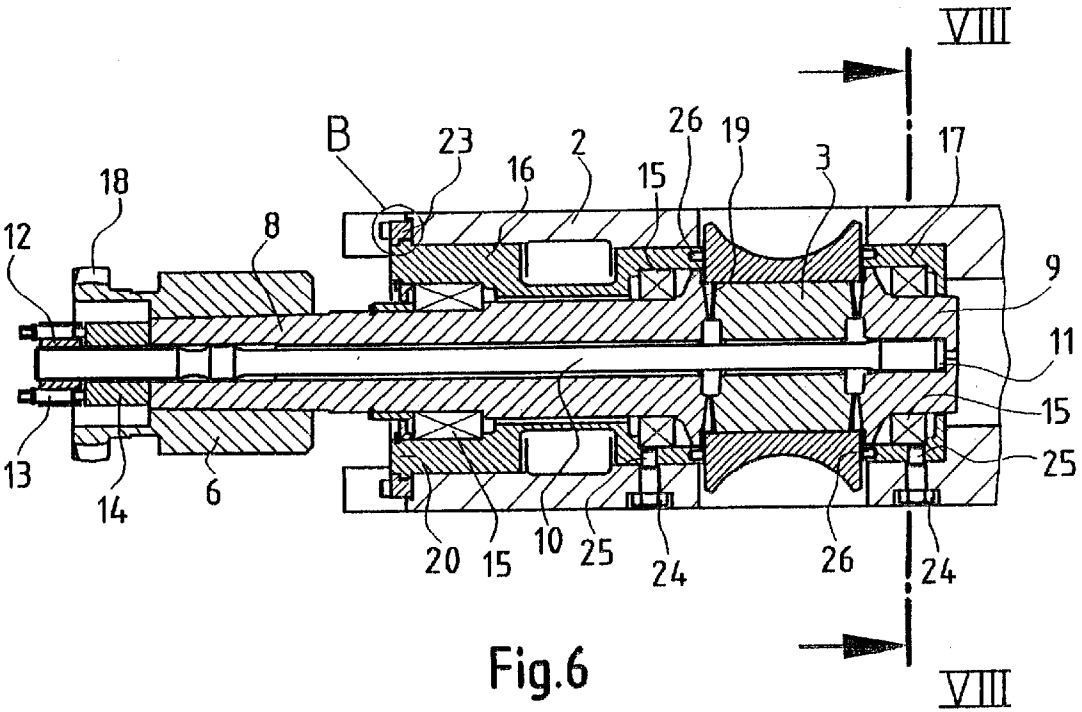
FIG. 6 is a cross-sectional view through another embodiment of a rolling unit according the invention, similar to the view of the embodiment of FIG. 3.

FIGS. 6 and 7 substantially correspond to FIGS. 3 and 4 but are for another embodiment. They show retaining ring 23, with which the flange 20 of the eccentric sleeve 16 may be fixed in an axially unmovable position, while permitting radial motion. In order to adjust and hold the eccentric sleeve 16 in a predetermined rotational position in this embodiment, a retaining screw 24 is screwed through the wall of the rolling unit housing 2 in a radial direction from the outside. The retaining screw 24 engages in a radial passage 25 provided in the outer peripheral surface 16" of the eccentric sleeve 16. Several passages 25 are provided distributed around the circumference of the eccentric sleeve 16, which permit several rotational positions for it and thus several rotational adjustments of the roll 3. Front passages 26 for rotating the eccentric sleeve 16, in which a pin key engages, can be used for these adjustments with roll 3 removed.

Figure 8:
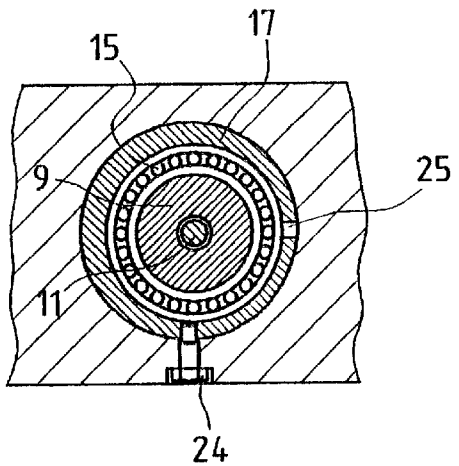
FIG. 8 is a cross-sectional view through the rolling unit shown in FIG. 6 taken along the section line VIII—VIII in FIG. 6.

FIG. 8 shows that the shorter eccentric sleeve 17 is secured in the same way by means of this sort of retaining screw 24 engaged in a passage in the outer peripheral surface 17". Also the rotational position of this eccentric sleeve 17 can be adjusted by hand with a pin key, which engages in the facing passages 26, when the retaining screws 24 are removed. Furthermore FIG. 8 shows the eccentricity of the eccentric sleeve 17, which is the same as that of the eccentric sleeve 16, especially clearly.

Figure 9:
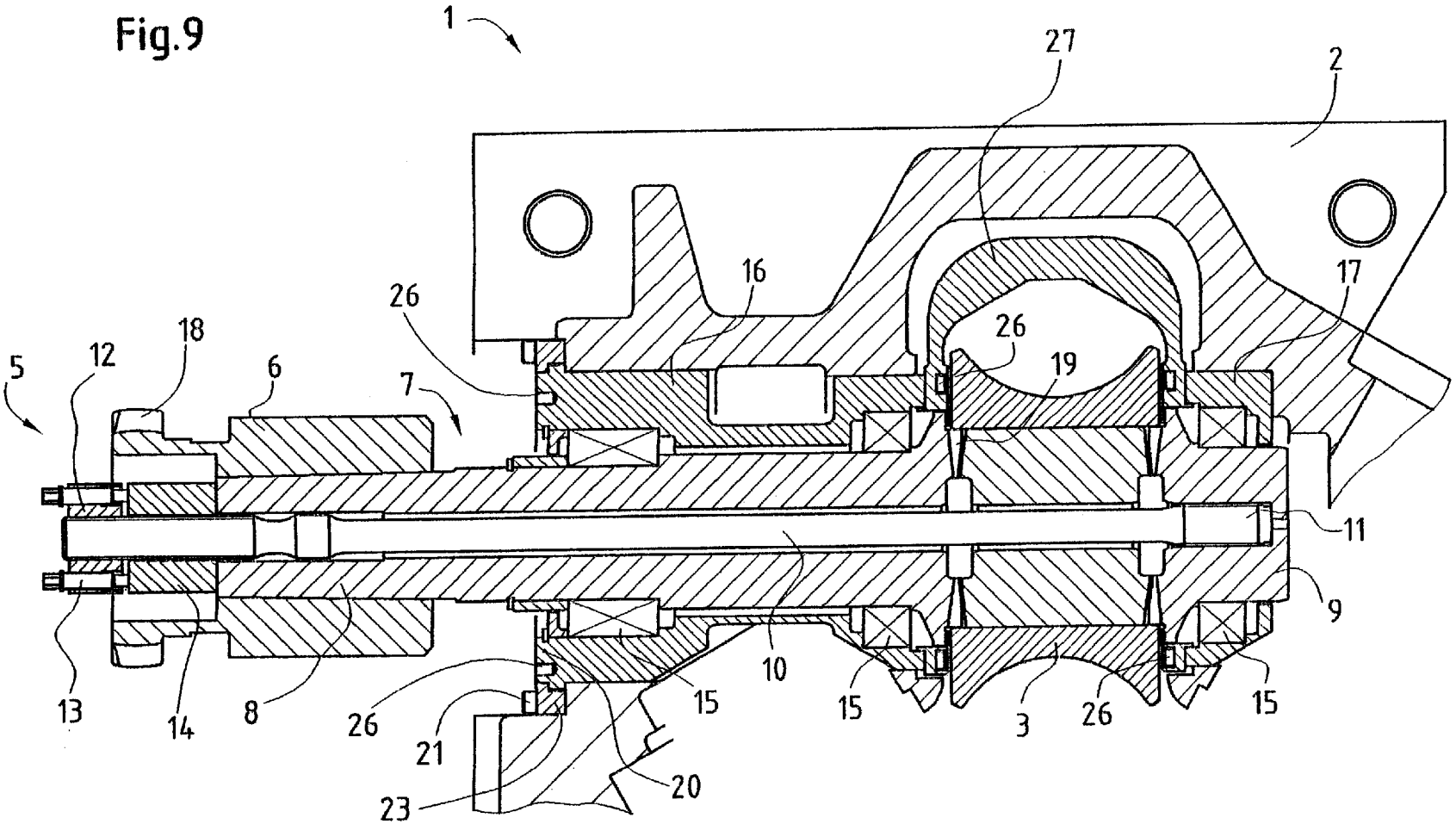
FIG. 9 is a partially cross-sectional, partially side view of an additional embodiment of a rolling unit according to the invention.

The additional embodiment according to FIG. 9 largely corresponds to that of FIG. 6, except that both eccentric sleeves 16 and 17 are connected with each other with a connecting strap 27 embracing the roll 3. The connecting strap 27 is screwed to opposing or facing sides of both eccentric sleeves 16,17. Consequently if only one of both eccentric sleeves 16,17 is axially fixed and in a fixed rotational position with the above-described means, then the other eccentric sleeve is similar fixed by the connecting strap 27. The facing passages 26 for a pin key for adjusting the rotational position are found here both in the connecting strap 27 and also in the flange 20 of the eccentric sleeve 16, in order to be able to insert a pin key according to choice at different positions, according to which position is better.

The disclosure in German Patent Application 100 15 339.9 of Mar. 28, 2000 is incorporated here by reference. This German Patent Application describes the invention described hereinabove and claimed in the claims appended hereinbelow and provides the basis for a claim of priority for the instant invention under 35 U.S.C. 119.

While the invention has been illustrated and described as embodied in a rolling unit for a rolling mill for rolling or sizing pipes, bars or wires, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims

I claim:

1. A rolling unit (1) for a rolling mill for rolling or sizing metal pipes, bars or wires, said rolling unit comprising a rolling unit housing (2);

at least three rolls (3) arranged on at least three roll shafts (7) respectively so as to surround a rolling mill axis (4) in a star arrangement in the rolling unit housing (2), and each of said roll shafts is divided into two shaft portions (8,9);

a separate drive mechanism (5) for each of said rolls;

eccentric sleeves (16,17) for each of said roll shafts (7) arranged in respective bearing passages (16',17') provided in said rolling unit housing (2) so that said eccentric sleeves (16,17) for each of said roll shafts (7) are manually rotatable between a plurality of rotational positions in said respective bearing passages in a stepwise manner without an adjusting device and are securable in each of said rotational positions; and roller bearings (15) for each of the roll shafts (7) arranged within said eccentric sleeves (16,17) and on both sides of each of said roll shafts so that said rolls (3) are rotatably mounted in said rolling unit housing (2), wherein said rolling unit housing (2) is a one-piece housing.

2. The rolling unit as defined in claim 1, wherein each of said roll shafts (7) is divided into two shaft portions (8,9) and further comprising means for releasably clamping said rolls (3) between said two shaft portions (8,9) of each of said roll shafts (7) respectively.

3. The rolling unit as defined in claim 2, wherein opposing surfaces of said shaft portions (8,9) and opposing surfaces of said rolls (3) held between said shaft portions are provided with respective depressions and corresponding projections so that said shaft portions and said rolls fit together in a form-locking manner.

4. The rolling unit as defined in claim 1, wherein one (16) of said eccentric sleeves (16,17) on a drive-mechanism-side of said roll (3) on each of said roll shaft (7) has a flange (20) facing said drive mechanism (5) and further comprising a retaining ring (23) screwed onto said rolling unit housing (2) so as to hold said one (16) of said eccentric sleeves axially fixed, but rotatable.

5. The rolling unit as defined in claim 1, wherein each of said roll shafts (7) is provided with two of said eccentric sleeves (16,17), said two of said eccentric sleeves are arranged on opposite sides of said roll (3) mounted on said roll shaft and are spaced from each other, and further comprising means for nonrotatably, but releasably, connecting said two of said eccentric sleeves (16,17) with each other, said means for nonrotatably, but releasably connecting, comprising a connecting strap (27).

6. A rolling unit (1) for a rolling mill for rolling or sizing metal pipes, bars or wires, said rolling unit comprising a rolling unit housing (2);

at least three rolls (3) arranged on at least three roll shafts (7) respectively so as to surround a rolling mill axis (4) in a star arrangement in the rolling unit housing (2);

a separate drive mechanism (5) for each of said rolls;

eccentric sleeves (16,17) for each of said roll shafts (7) arranged in respective bearing passages (16',17') provided in said rolling unit housing (2) so that said eccentric sleeves (16,17) for each of said roll shafts (7) are manually rotatable between a plurality of rotational positions in said respective bearing passages in a stepwise manner without an adjusting device and are securable in each of said rotational positions; and roller bearings (15) for each of the roll shafts (7) arranged within said eccentric sleeves (16,17) and on both sides of each of said roll shafts so that said rolls (3) are rotatably mounted in said rolling unit housing (2), wherein each of said roll shafts (7) is divided into two shaft portions (8,9) and further comprising means for releasably clamping said rolls (3) between said two shaft portions (8,9) of each of said roll shafts (7) respectively, wherein opposing surfaces of said shaft portions (8,9) and opposing surfaces of said rolls (3) held between said shaft portions are provided with respective depressions and corresponding projections so that said shaft portions and said rolls fit together in a form-locking manner, wherein said opposing surfaces of said shaft portions (8,9) have smaller diameters than those of ones (16') of said respective bearing passages of the rolling unit housing (2) located between said rolls (3) and said drive mechanisms (5).

7. A rolling unit (1) for a rolling mill for rolling or sizing metal pipes, bars or wires, said rolling unit comprising a rolling unit housing (2);

at least three rolls (3) arranged on at least three roll shafts (7) respectively so as to surround a rolling mill axis (4) in a star arrangement in the rolling unit housing (2);

a separate drive mechanism (5) for each of said rolls;

eccentric sleeves (16,17) for each of said roll shafts (7) arranged in respective bearing passages (16',17') provided in said rolling unit housing (2) so that said eccentric sleeves (16,17) for each of said roll shafts (7) are manually rotatable between a plurality of rotational positions in said respective bearing passages in a stepwise manner without an adjusting device and are securable in each of said rotational positions; and roller bearings (15) for each of the roll shafts (7) arranged within said eccentric sleeves (16,17) and on both sides of each of said roll shafts so that said rolls (3) are rotatably mounted in said rolling unit housing (2), wherein one (16') of said respective bearing passages (16',17') of the rolling unit housing (2) for the eccentric sleeves (16,17) for each of said roll shafts (7) is less than or equal in size to another (17') of said respective bearing passages located in front of said one (16') of said respective bearing passages in a direction from the drive mechanism (5) associated therewith to an interior of the rolling unit housing (2).

8. A rolling unit (1) for a rolling mill for rolling or sizing metal pipes, bars or wires, said rolling unit comprising a rolling unit housing (2);

at least three rolls (3) arranged on at least three roll shafts (7) respectively so as to surround a rolling mill axis (4) in a star arrangement in the rolling unit housing (2);

a separate drive mechanism (5) for each of said rolls;

eccentric sleeves (16,17) for each of said roll shafts (7) arranged in respective bearing passages (16',17') provided in said rolling unit housing (2) so that said eccentric sleeves (16,17) for each of said roll shafts (7) are manually rotatable between a plurality of rotational positions in said respective bearing passages in a stepwise manner without an adjusting device and are securable in each of said rotational positions; and roller bearings (15) for each of the roll shafts (7) arranged within said eccentric sleeves (16,17) and on both sides of each of said roll shafts so that said rolls (3) are rotatably mounted in said rolling unit housing (2), wherein one (16) of said eccentric sleeves (16,17) on a drive-mechanism-side of said roll (3) on each of said roll shafts (7) has a flange (20) facing said drive mechanism (5), a plurality of securing passages (22) are distributed circumferentially in respective opposing surfaces of said flange (20) and of a part of said rolling unit housing (2) covered by said flange and a plurality of pins or screws (21) are provided for insertion in said securing passages (22) for alignment and holding of said eccentric sleeve in one of said plurality of said rotational positions.

9. A rolling unit (1) for a rolling mill for rolling or sizing metal pipes, bars or wires, said rolling unit comprising a rolling unit housing (2);

at least three rolls (3) arranged on at least three roll shafts (7) respectively so as to surround a rolling mill axis (4) in a star arrangement in the rolling unit housing (2);

a separate drive mechanism (5) for each of said rolls;

eccentric sleeves (16,17) for each of said roll shafts (7) arranged in respective bearing passages (16',17') provided in said rolling unit housing (2) so that said eccentric sleeves (16,17) for each of said roll shafts (7) are manually rotatable between a plurality of rotational positions in said respective bearing passages in a stepwise manner without an adjusting device and are securable in each of said rotational positions; and roller bearings (15) for each of the roll shafts (7) arranged within said eccentric sleeves (16,17) and on both sides of each of said roll shafts so that said rolls (3) are rotatably mounted in said rolling unit housing (2), wherein at least one of said eccentric sleeves (16,17) for each of said roll shafts (7) is provided with radial passages (25) circumferentially distributed in outer peripheral surfaces (16",17") of said eccentric sleeves and at least one retaining screw (24) is screwed into at least one of said radial passages (25) from outside through a wall of said rolling unit housing (2) in order to secure the at least one of said eccentric sleeves in one of said plurality of said rotational positions in the rolling unit housing (2).

* * * * *